US008517745B1

(12) United States Patent
Yang et al.

(10) Patent No.: US 8,517,745 B1
(45) Date of Patent: Aug. 27, 2013

(54) CARD CONNECTOR

(75) Inventors: Ou Yang, Guang-Dong (CN); Ping-Chih Chen, New Taipei (TW); Ming-Chiang Chen, New Taipei (TW)

(73) Assignee: Cheng UEI Precision Industry Co., Ltd., New Taipei (TW), `

( * ) Notice: Subject to any disclaimer, the term of this patent is extended or adjusted under 35 U.S.C. 154(b) by 3 days.

(21) Appl. No.: 13/438,825

(22) Filed: Apr. 3, 2012

(51) Int. Cl.
*H01R 13/62* (2006.01)

(52) U.S. Cl.
USPC ..... 439/152; 439/541.5; 439/607.33

(58) Field of Classification Search
USPC ..... 439/152, 159, 540.1, 541.5, 607.31, 439/607.33, 630
See application file for complete search history.

(56) References Cited

U.S. PATENT DOCUMENTS 5,013,255 A * 5/1991 Juret et al. ..... 439/260
6,146,195 A * 11/2000 Chang ..... 439/541.5
6,634,905 B2 * 10/2003 Kuo ..... 439/541.5
6,814,622 B1 * 11/2004 Lai et al. ..... 439/631
7,670,168 B2 * 3/2010 Ting ..... 439/377

* cited by examiner

*Primary Examiner* — Khiem Nguyen
(74) *Attorney, Agent, or Firm* — Cheng-Ju Chiang

(57) ABSTRACT

A card connector includes a first insulating housing defining a first receiving room, a second insulating housing defining a second receiving room, a first terminal group molded in the first insulating housing and having a plurality of first contact portions which project in the first receiving room, a second terminal group molded in the second insulating housing and having a plurality of second contact portions which project in the second receiving room, a drawer and a shielding shell. The first insulating housing is mounted on the second insulating housing, and the drawer is movably assembled between the first insulating housing and the second insulating housing. The drawer has two blocking slices bending downward to stretch in the second receiving room for ejecting a card out of the second receiving room by pulling the drawer outward. The shielding shell encloses the insulating housings.

12 Claims, 4 Drawing Sheets

CARD CONNECTOR

BACKGROUND OF THE INVENTION

1. Field of the Invention

The present invention relates to a card connector, and more particularly to a double-deck card connector.

2. The Related Art

A card connector is often used for connecting external electronic cards with electronic products for realizing signal transmission between the electronic cards and the electronic products. At present, the card connector is more and more widely used in people's daily life. And the rapid development of electronic technology calls for more stringent requirements to miniaturization and multi-function of the card connector. People often hope that the card connector not only can process a variety of different information, but also can comply with the miniaturization requirement. So, a card connector capable of receiving many electronic cards and meeting the miniaturization requirement comes with the tide of fashion.

SUMMARY OF THE INVENTION

Accordingly, an object of the present invention is to provide a card connector adapted for receiving two cards therein. The card connector includes a first insulating housing with a first receiving room being transversely opened in a top thereof and penetrating through a front thereof, a second insulating housing with a second receiving room being transversely opened in a top thereof and penetrating through a front thereof, a first terminal group molded in the first insulating housing and having a plurality of first contact portions and first soldering tails, a second terminal group molded in the second insulating housing and having a plurality of second contact portions and second soldering tails, a drawer and a shielding shell. A bottom sidewall of the first receiving room is recessed downward to form at least one first receiving cavity. A bottom sidewall of the second receiving room is recessed downward to form at least one second receiving cavity. The first contact portions stretch in the first receiving cavity and further project upward into the first receiving room. The second contact portions stretch in the second receiving cavity and further project upward into the second receiving room. The first insulating housing is mounted on the second insulating housing with the first soldering tails and the second soldering tails projecting out of bottoms of side walls of the insulating housings and being substantially flush with a bottom surface of the second insulating housing. The drawer is movably assembled between the first insulating housing and the second insulating housing. The drawer has a base plate located over the second receiving room, and two blocking slices bending downward from two ends of a rear edge of the base plate. The blocking slices stretch in the second receiving room for ejecting the card out of the second receiving room by pulling the drawer outward. The shielding shell encloses the first and the second insulating housings.

As described above, the first terminal group and the second terminal group are molded in the first insulating housing and the second insulating housing, and then the first insulating housing together with the first terminal group is mounted on the second insulating housing together with the second terminal group, so that achieve a compact and steady structure of the card connector. Furthermore, the card connector utilizes the drawer to eject the card out of the second insulating housing so as to realize a smooth process of ejecting the card.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
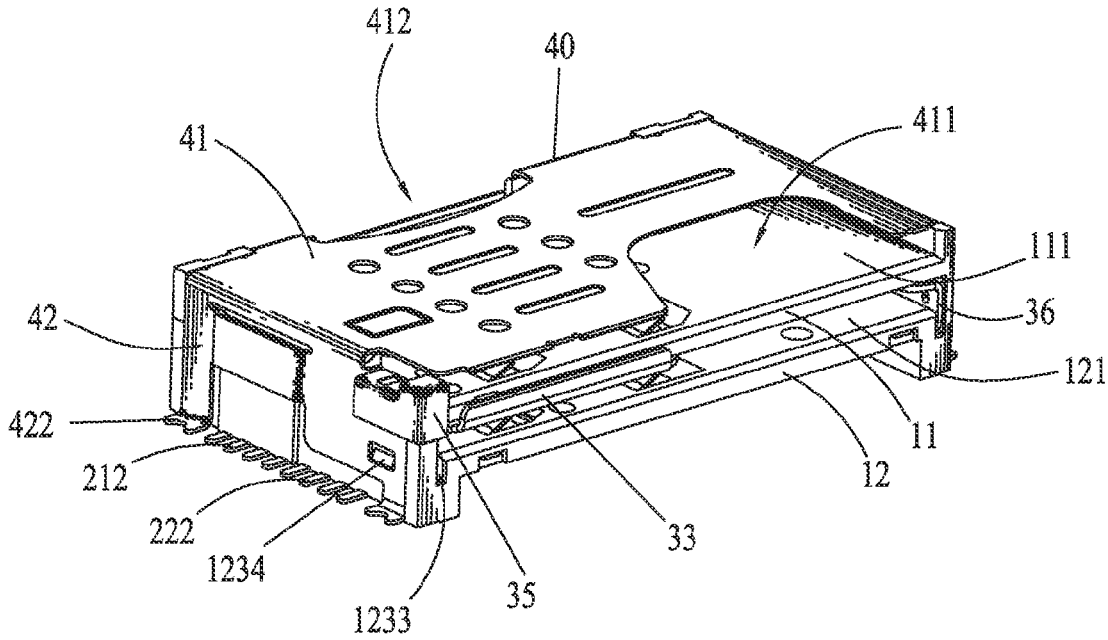
FIG. 1 is an assembled perspective view of a card connector according to an embodiment of the present invention.
Figure 2:
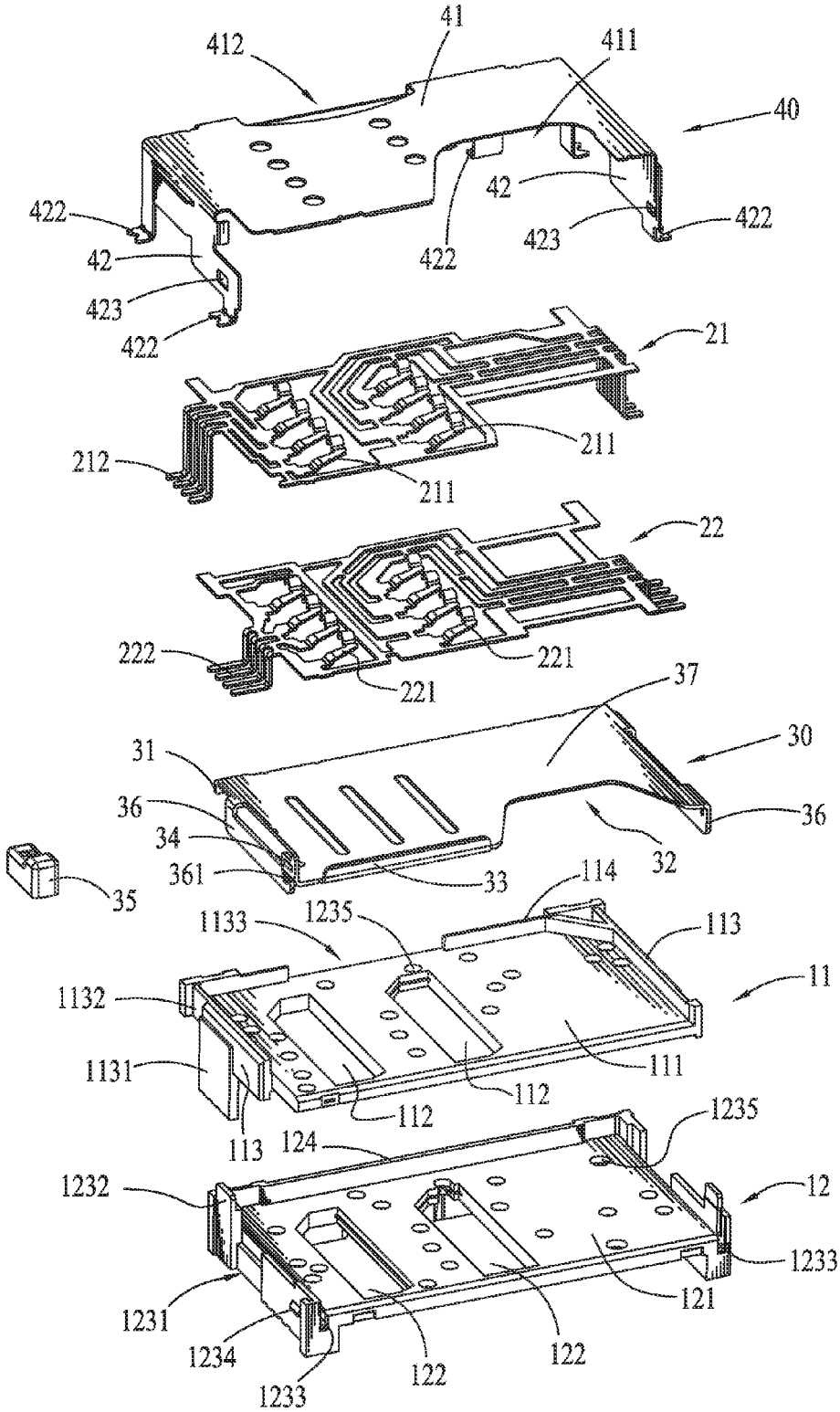
FIG. 2 is an exploded perspective view of the card connector of FIG. 1.
Figure 3:
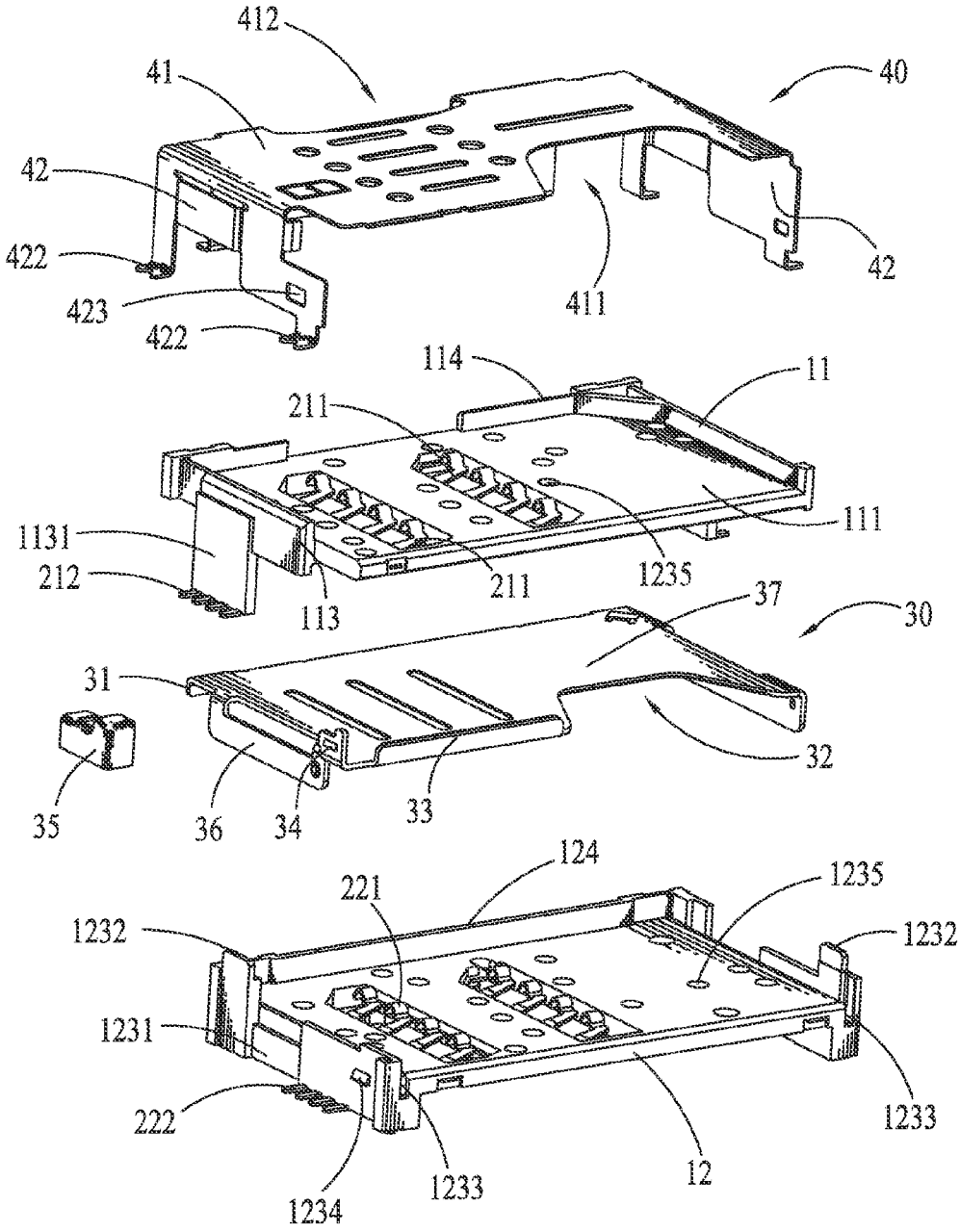
FIG. 3 is a partly exploded perspective view of the card connector of FIG. 1.
Figure 4:
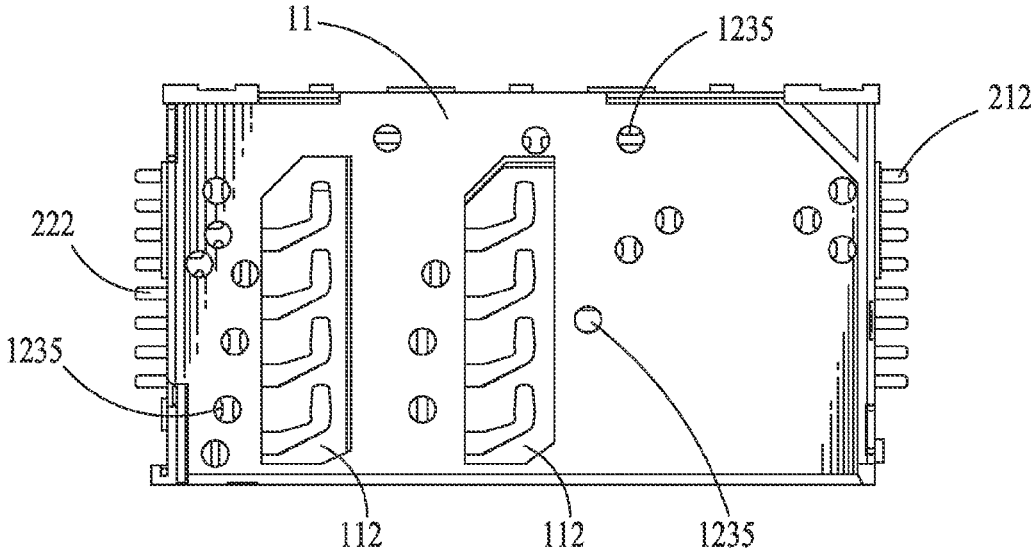
FIG. 4 is a vertical view of the card connector of FIG. 1 with a shielding shell being removed therefrom.

Referring to FIG. 1 and FIG. 2, a card connector according to an embodiment of the present invention is adapted for receiving two cards (not shown) therein. The card connector includes a first insulating housing 11, a second insulating housing 12, a first terminal group 21, a second terminal group 22, a drawer 30 and a shielding shell 40.

With reference to FIGS. 1-4, the first insulating housing 11 has a first receiving room 111 transversely opened in a top thereof and penetrating through a front thereof. A bottom sidewall of the first receiving room 111 is recessed downward to form at least one first receiving cavity 112. The second insulating housing 12 has a second receiving room 121 transversely opened in a top thereof and penetrating through a front thereof. A bottom sidewall of the second receiving room 121 is recessed downward to form at least one second receiving cavity 122.

The first terminal group 21 and the second terminal group 22 are formed by punching a metal plate respectively, and molded in the first insulating housing 11 and the second insulating housing 12 respectively. The first terminal group 21 has a plurality of first contact portions 211 which stretch in the first receiving cavity 112 and further project upward into the first receiving room 111, and a plurality of first soldering tails 212. The second terminal group 22 has a plurality of second contact portions 221 which stretch in the second receiving cavity 122 and further project upward into the second receiving room 121, and a plurality of second soldering tails 222. The first insulating housing 11 is mounted on the second insulating housing 12 with the first soldering tails 212 and the second soldering tails 222 projecting out of bottoms of side walls 113, 123 of the insulating housings 11, 12 and being substantially flush with a bottom surface of the second insulating housing 12. The bottom sidewalls of the first receiving room 111 and the second receiving room 121 respectively define a plurality of through-holes 1235 through which connected parts of the terminal groups 21, 22 are die-cut open after the terminal groups 21, 22 are molded in the first insulating housing 11 and the second insulating housing 12 respectively.

The drawer 30 is movably assembled between the first insulating housing 11 and the second insulating housing 12. The drawer 30 has a base plate 37 located over the second receiving room 121, and two blocking slices 31 bending downward from two ends of a rear edge of the base plate 37. The blocking slices 31 stretch in the second receiving room 121 for ejecting the card out of the second receiving room 121 by pulling the drawer 30 outward. The shielding shell 40 encloses the first and the second insulating housings 11, 12.

Referring to FIGS. 1-3 again, the drawer 30 is made of metal material. One end of a front edge of the base plate 37 is cut off to form a first gap 32 for the convenience of grasping the card. Two opposite sides of the bottom sidewall of the second receiving room 121 define a pair of sliding slots 1233 each extending along a front-to-rear direction to penetrate through the front of the second insulating housing 12. Two opposite side edges of the base plate 37 bend downward to form a pair of sliding plates 36 slidably inserted in the sliding slots 1233 to guide the movement of the drawer 30. A pair of convex bumps 361 protrudes outward on the sliding plates 36 to stabilize the movement of the drawer 30. The other end of the front edge of the base plate 37 bends upward to form a blocking plate 33 capable of resisting against the front of the first insulating housing 11 to avoid an excessive insertion of the drawer 30. A front end of one side edge of the base plate 37 protrudes upward to form a fastening portion 34. The card connector further includes a handle 35 mounted to the fastening portion 34 for the convenience of pulling out the drawer 30 outward therethrough.

Referring to FIGS. 1-3 again, the shielding shell 40 has a cover plate 41 located over the first receiving room 111. One end of a front edge of the cover plate 41 is cut off to form a second gap 411 for the convenience of grasping the card out of the first receiving room 111. Two opposite side edges and a rear edge of the cover plate 41 bend downward to form holding plates 42 abutting against the side walls 113, 123 and rear walls 114, 124 of the insulating housings 11, 12. Bottom edges of the holding plates 42 bend outward to form a plurality of soldering feet 422 flush with the soldering tails 212, 222 of the terminal groups 21, 22. A portion of a rear of the first receiving room 111 further penetrates rearward through the rear wall 114 of the first insulating housing 11 to form a pushing gap 1133. A portion of the rear edge of the cover plate 41 is cut off to form a pushing notch 412 further spread downward to the corresponding holding plate 42. The pushing notch 412 and the pushing gap 1133 communicate with each other for pushing the card outward therethrough. The side walls 123 and the rear wall 124 of the second insulating housing 12 protrude outward to form a plurality of buckling blocks 1234. The holding plates 42 of the shielding shell 40 accordingly define a plurality of buckling holes 423 for buckling the buckling blocks 1234 therein.

In this embodiment, each side wall 113 of the first insulating housing 11 defines an insertion groove 1132 and extends downward to form an insertion board 1131. Accordingly, a part of each side wall 123 of the second insulating housing 12 protrudes upward to form an insertion portion 1232 held in the corresponding insertion groove 1132, and an insertion fillister 1231 is opened in each side wall 123 of the second insulating housing 12 for holding the insertion board 1131 therein. So, a firm assembly is realized between the first insulating housing 11 and the second insulating housing 12.

As described above, the first terminal group 21 and the second terminal group 22 are molded in the first insulating housing 11 and the second insulating housing 12, and then the first insulating housing 11 together with the first terminal group 21 is mounted on the second insulating housing 12 together with the second terminal group 22, so that achieve a compact and steady structure of the card connector. Furthermore, the card connector utilizes the drawer 30 to eject the card out of the second insulating housing 12 so as to realize a smooth process of ejecting the card.

What is claimed is:

1. A card connector for receiving two cards therein, comprising:

a first insulating housing with a first receiving room being transversely opened in a top thereof and penetrating through a front thereof, a bottom sidewall of the first receiving room being recessed downward to form at least one first receiving cavity;

a second insulating housing with a second receiving room being transversely opened in a top thereof and penetrating through a front thereof, a bottom sidewall of the second receiving room being recessed downward to form at least one second receiving cavity;

a first terminal group molded in the first insulating housing and having a plurality of first contact portions and first soldering tails, the first contact portions stretching in the first receiving cavity and further projecting upward into the first receiving room;

a second terminal group molded in the second insulating housing and having a plurality of second contact portions and second soldering tails, the second contact portions stretching in the second receiving cavity and further projecting upward into the second receiving room, wherein the first insulating housing is mounted on the second insulating housing with the first soldering tails and the second soldering tails projecting out of bottoms of side walls of the insulating housings and being substantially flush with a bottom surface of the second insulating housing;

a drawer movably assembled between the first insulating housing and the second insulating housing, the drawer having a base plate located over the second receiving room, and two blocking slices bending downward from two ends of a rear edge of the base plate, the blocking slices stretching in the second receiving room for ejecting the card out of the second receiving room by pulling the drawer outward; and a shielding shell enclosing the first and the second insulating housings.

2. The card connector as claimed in claim 1, wherein the drawer is made of metal material.

3. The card connector as claimed in claim 1, wherein one end of a front edge of the base plate is cut off to form a first gap for the convenience of grasping the card.

4. The card connector as claimed in claim 1, wherein two opposite sides of the bottom sidewall of the second receiving room define a pair of sliding slots each extending along a front-to-rear direction to penetrate through the front of the second insulating housing, two opposite side edges of the base plate bend downward to form a pair of sliding plates slidably inserted in the sliding slots to guide the movement of the drawer.

5. The card connector as claimed in claim 4, wherein a pair of convex bumps protrudes outward on the sliding plates to stabilize the movement of the drawer.

6. The card connector as claimed in claim 4, wherein the other end of the front edge of the base plate bends upward to form a blocking plate capable of resisting against the front of the first insulating housing to avoid an excessive insertion of the drawer.

7. The card connector as claimed in claim 4, wherein a front end of one side edge of the base plate protrudes upward to form a fastening portion, the card connector further includes a handle mounted to the fastening portion for the convenience of pulling out the drawer outward therethrough.

8. The card connector as claimed in claim 1, wherein the shielding shell has a cover plate located over the first receiving room, one end of a front edge of the cover plate is cut off to form a second gap for the convenience of grasping the card out of the first receiving room.

9. The card connector as claimed in claim 8, wherein two opposite side edges and a rear edge of the cover plate bend downward to form holding plates abutting against the side walls and rear walls of the insulating housings, bottom edges of the holding plates bend outward to form a plurality of soldering feet flush with the soldering tails of the terminal groups, a portion of a rear of the first receiving room further penetrates rearward through the rear wall of the first insulating housing to form a pushing gap, a portion of the rear edge of the cover plate is cut off to form a pushing notch further spread downward to the corresponding holding plate, the pushing notch and the pushing gap communicate with each other for pushing the card outward therethrough.

10. The card connector as claimed in claim 9, wherein the side walls and the rear wall of the second insulating housing protrude outward to form a plurality of buckling blocks, the holding plates of the shielding shell accordingly define a plurality of buckling holes for buckling the buckling blocks therein.

11. The card connector as claimed in claim 1, wherein each side wall of the first insulating housing defines an insertion groove and extends downward to form an insertion board, accordingly, a part of each side wall of the second insulating housing protrudes upward to form an insertion portion held in the corresponding insertion groove, and an insertion fillister is opened in each side wall of the second insulating housing for holding the insertion board therein.

12. The card connector as claimed in claim 1, wherein the first terminal group and the second terminal group are formed by punching a metal plate respectively, the bottom sidewalls of the first receiving room and the second receiving room respectively define a plurality of through-holes through which connected parts of the terminal groups are die-cut open after the terminal groups are molded in the first insulating housing and the second insulating housing respectively.

* * * * *